United States Patent [19]

Moore

[11] Patent Number: 4,630,877

[45] Date of Patent: Dec. 23, 1986

[54] SOCKET

[75] Inventor: Marvin W. Moore, Oxford, Mich.

[73] Assignee: Microdot Inc., Darien, Conn.

[21] Appl. No.: 798,434

[22] Filed: Nov. 15, 1985

[51] Int. Cl.[4] ..... H01R 11/00

[52] U.S. Cl. ..... 339/60 M; 339/59 L; 339/91 L; 339/176 L; 339/145 R

[58] Field of Search ..... 339/59 L, 60 R, 60 C, 339/60 M, 61 L, 61 R, 61 M, 91 L, 176 L, 177 L, 144, 145 R

[56] References Cited

U.S. PATENT DOCUMENTS 3,805,211 4/1974 Moore ..... 339/176 L
3,999,095 12/1976 Pearce, Jr. et al. ..... 339/91 L
4,101,187 7/1978 Collier ..... 339/59 L
4,573,754 3/1986 Hill ..... 339/60 M

*Primary Examiner*—Gil Weidenfeld
*Assistant Examiner*—Paula A. Austin
*Attorney, Agent, or Firm*—Lyman R. Lyon

[57] ABSTRACT

A socket for the reception of a bulb comprising a housing having a grommet receptacle therein for the acceptance of a grommet in sealing relationship. An electrically conductive wire extends through the grommet for connection to an internal terminal strip of the housing. An integral latch on the housing biases the grommet into its receptacle in the housing and secures the grommet in position therein.

5 Claims, 11 Drawing Figures

FIG. 6.
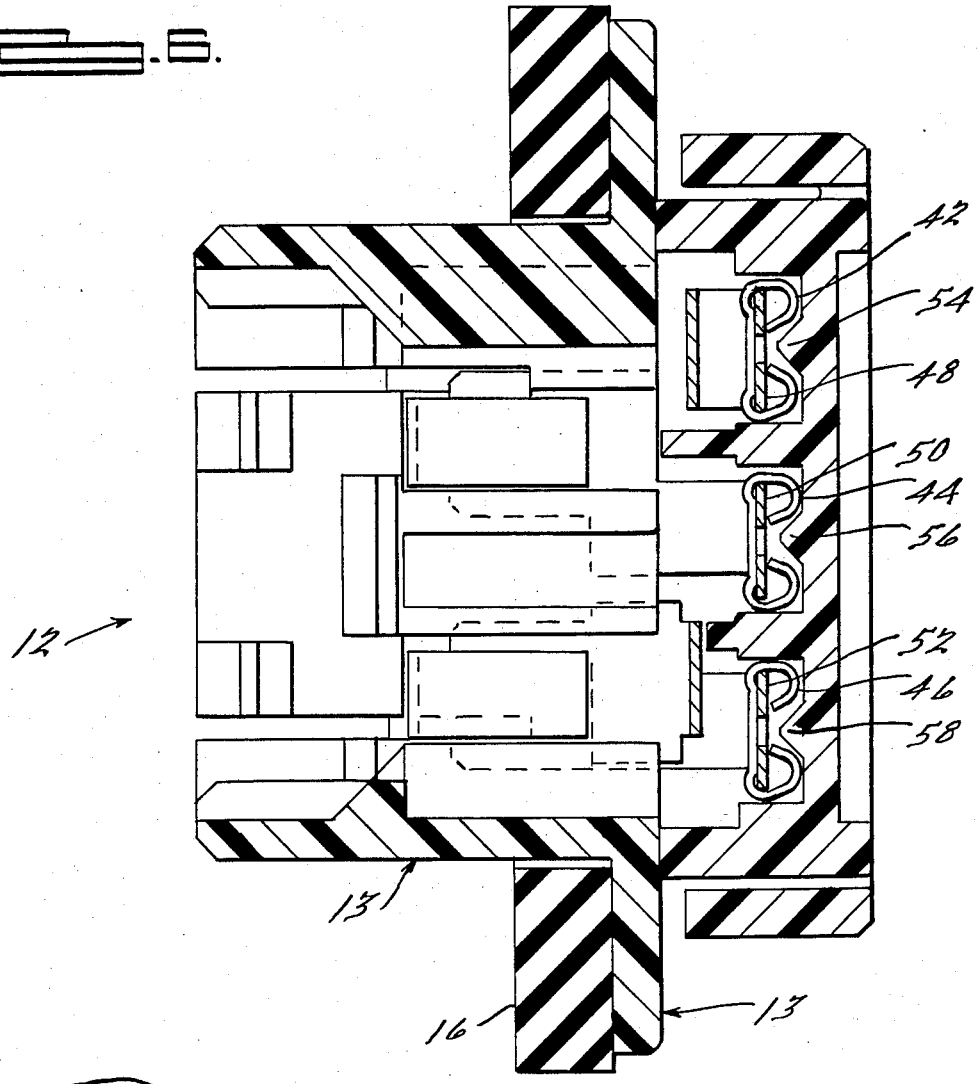
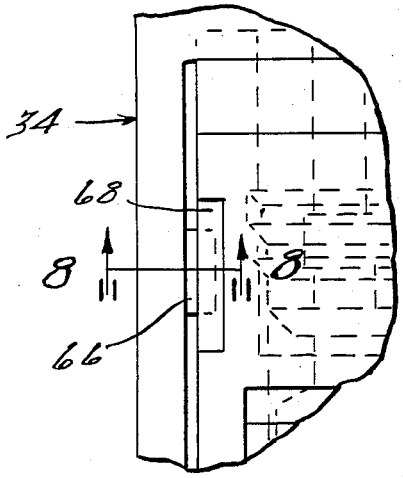
FIG. 7.
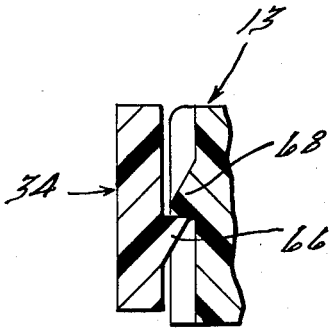
FIG. 8.

FIG. 10.
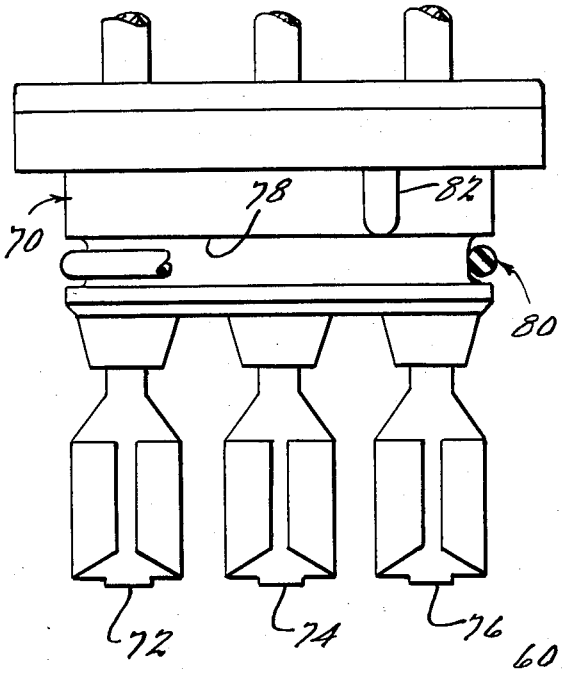
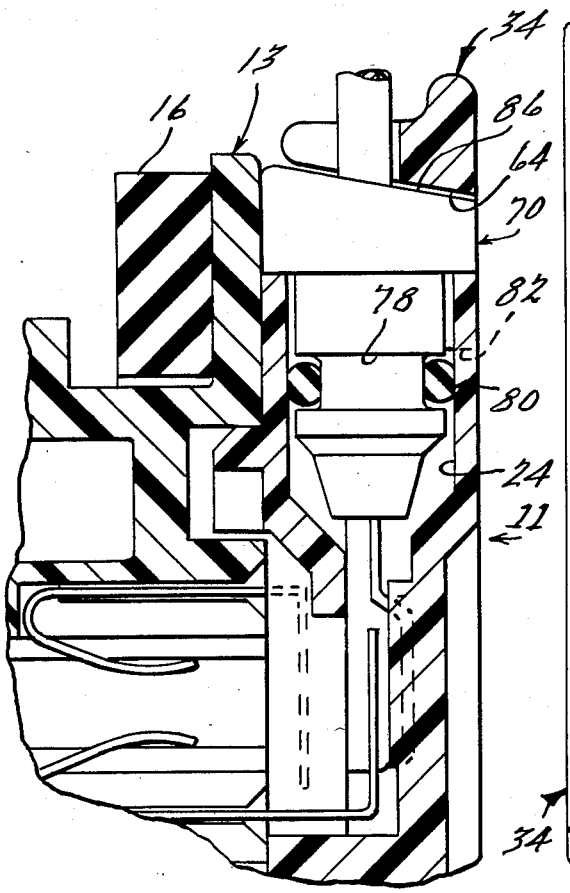
FIG. 9.
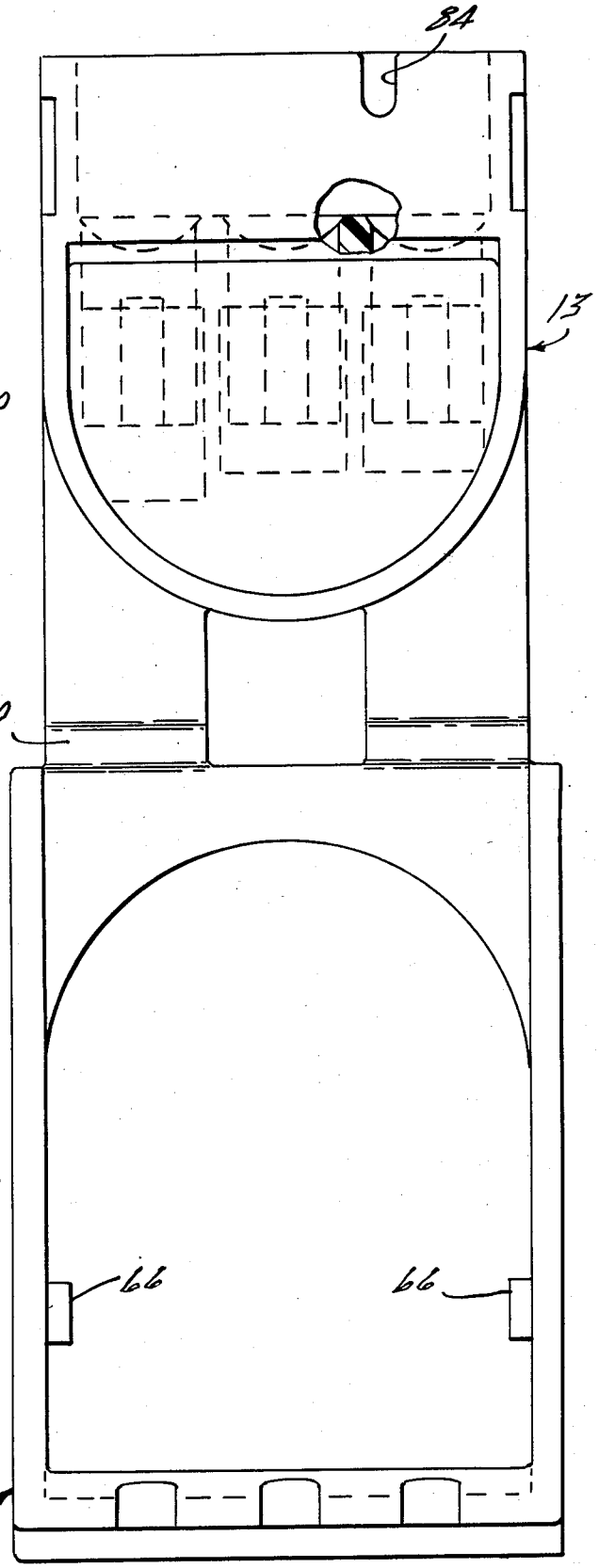
FIG. 11.

SOCKET

BACKGROUND OF THE INVENTION

Sockets used in the electrical wiring systems of automobiles and other vehicles generally comprise a housing having one or more terminals internally thereof for electrical engagement with both the contacts on the end of a light bulb and the electrical conductors of a wiring harness.

One problem with known sockets is that moisture is capable of infiltrating the housing of the socket ultimately causing corrosion and failure of the electrical contact between the bulb and the internal terminals of the socket. Attempts to solve this problem have generally required permanent sealing of the wires leading into the socket housing. While such practices insure positive sealing, service of the socket housing is rendered impossible and, upon failure thereof due to other circumstances, the entire socket must be replaced. Attempts to sealably yet removably attach the wires to the socket housing have heretofore failed.

SUMMARY OF THE INVENTION

The present invention solves the aforementioned problem by utilizing a unique grommet that is sealably retained in a complementary receptacle in the socket housing. The grommet functions to support and seal the wires leading into the socket housing as well as support wire terminations within the socket housing that are engageable with internal terminals thereof. The grommet is positively retained in position by an integrally hinged latch.

BRIEF DESCRIPTION OF THE DRAWINGS

FIG. 6 is a cross-sectional view taken along the line 6—6 of FIG. 2;

FIG. 7 is a view taken within the circle 7 of FIG. 3;

FIG. 8 is a sectional view taken along the line 8—8 of FIG. 7;

FIG. 9 is a view similar to FIG. 4 of another embodiment of the invention;

FIG. 10 is a view of the grommet of FIG. 9 removed from the socket; and

FIG. 11 is a view taken in the direction of the arrow 11 of FIG. 9 with the grommet latch in the unlatched condition.

DETAILED DESCRIPTION OF THE PREFERRED EMBODIMENT OF THE INVENTION

Figure 1:
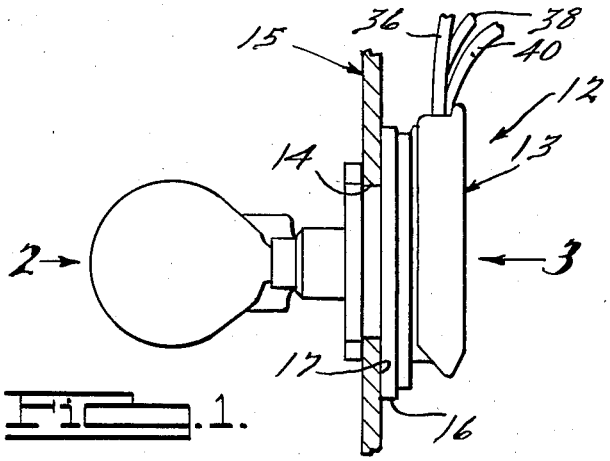
FIG. 1 is a side elevation of an improved socket in accordance with the present invention, shown mounted in a complementary aperture in a light fixture.

As seen in FIG. 1 of the drawings, a sealed socket 12, in accordance with a constructed embodiment of the present invention, comprises a housing 13 adapted to be mounted in a complementary aperture 14 in a fixture or receptacle 15. A sealing gasket 16 is disposed between the housing 13 and an outer surface 17 of the receptacle 15 adjacent the aperture 14 therein.

The housing 13 is provided with conventional locking dogs 18, 19 and 20 which are accepted through complementary apertures in the receptacle 15 (not shown).

Figure 4:
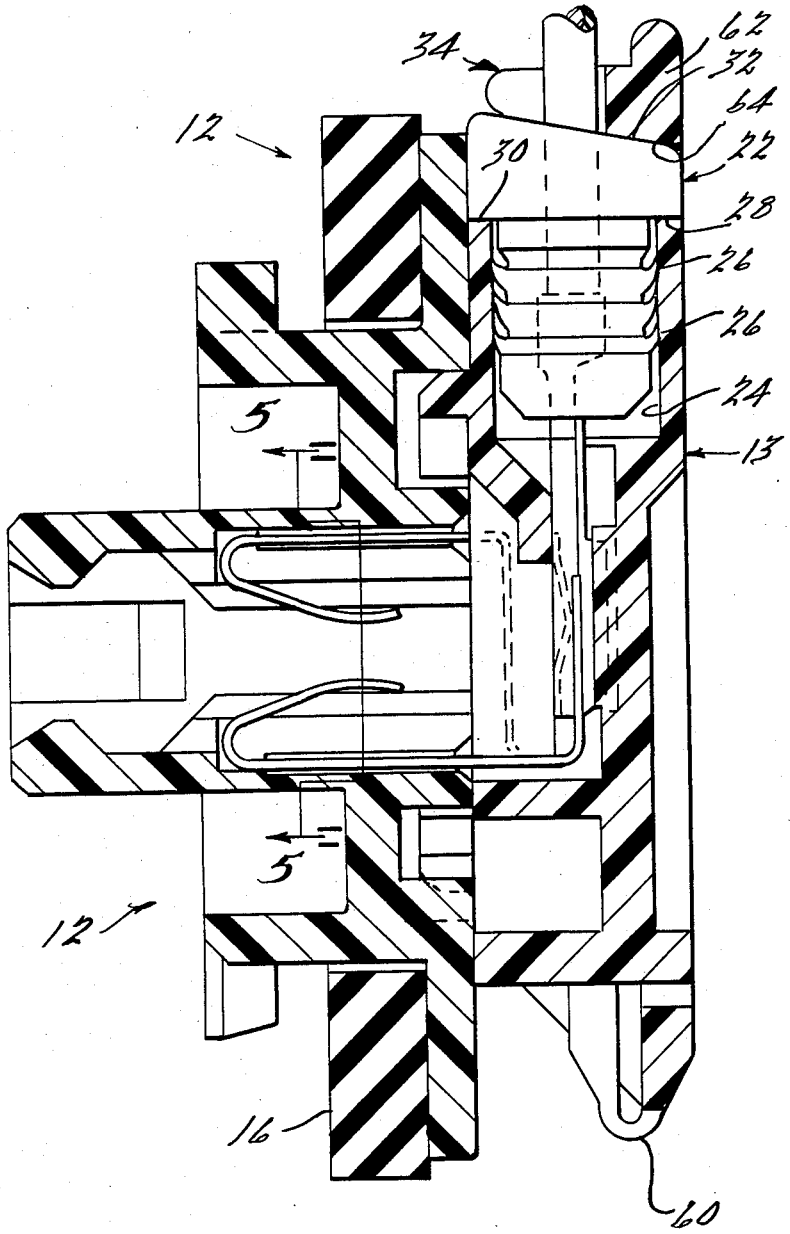
FIG. 4 is a cross-sectional view taken generally along the line 4—4 of FIG. 2.
Figure 5:
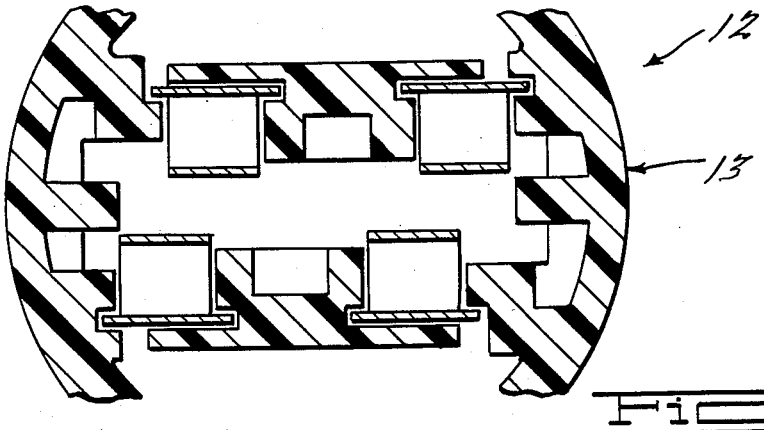
FIG. 5 is a cross-sectional view taken along the line 5—5 of FIG. 4.

As best seen in FIG. 4 of the drawings, a relatively soft plastic or rubber grommet 22 is mounted in a complementary grommet receptacle 24 in the housing 13. The grommet 22 has a plurality of continuous flexible ribs 26 that engage the inner wall of the recess 24 in the housing 13 in sealing relationship. The grommet 22 is positioned internally of the receptacle 24 by a shoulder 28 on the grommet 22 that engages a complementary shoulder 30 on the housing 13.

In accordance with one feature of the instant invention, the grommet 22 has an angularly related outer wall 32 disposed in a camming relationship with an integral foldable latch 34 on the housing 13, as will be described.

Figure 3:
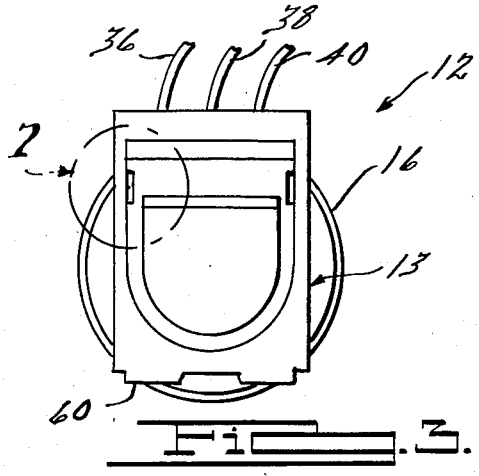
FIG. 3 is a view taken in the direction of the arrow 3 of FIG. 1.
Figure 2:
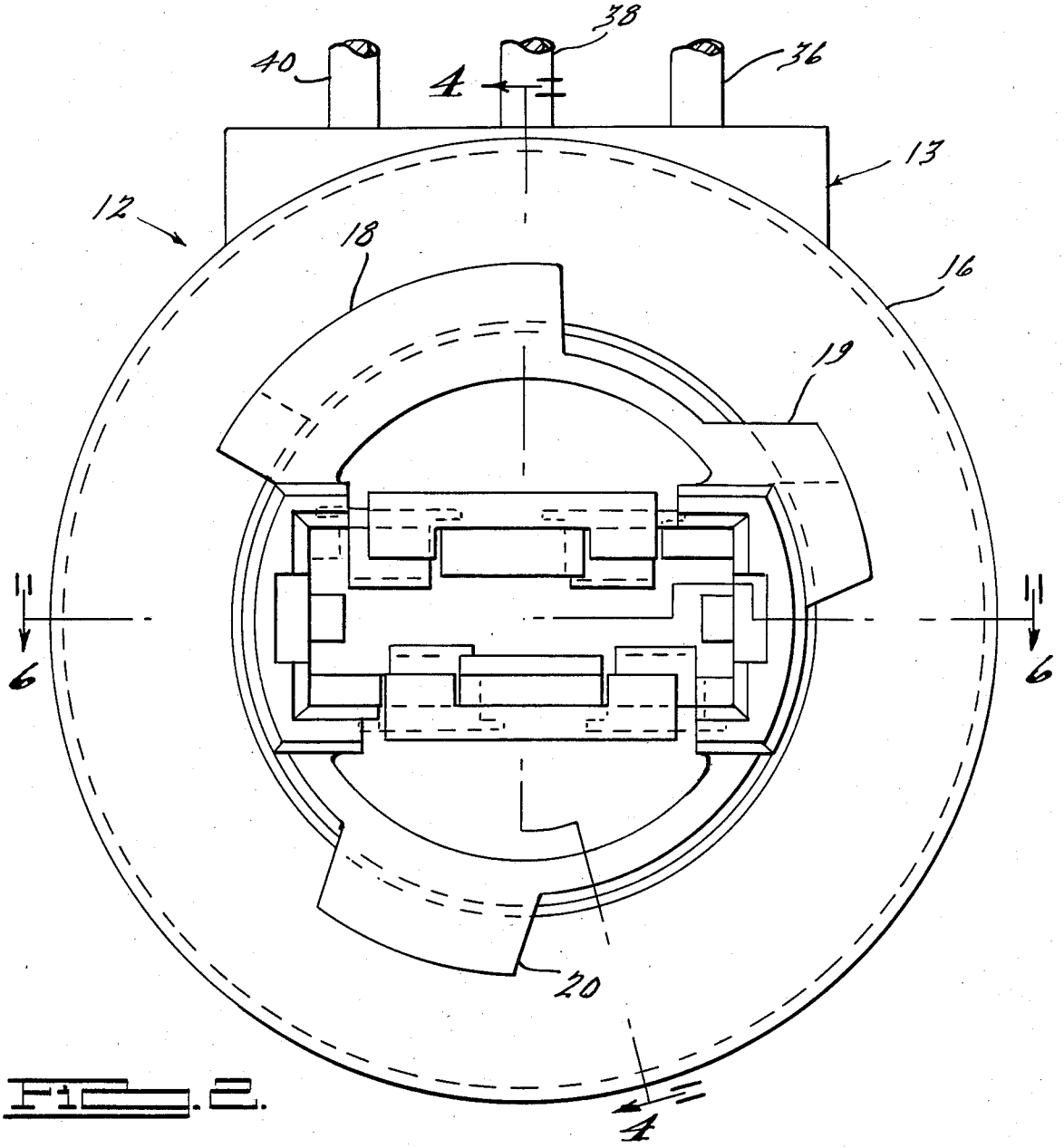
FIG. 2 is a view taken in the direction of the arrow 2 of FIG. 1 with the socket removed from the fixture and the bulb removed.

As seen in FIG. 3, a plurality of wires 36, 38 and 40 extend through the center of the grommet 22 in sealed relation thereto. The wires 36, 38 and 40 are terminated with conventional terminals 42, 44 and 46 that make electrical contact with complementary terminal strips 48, 50 and 52, respectively, mounted internally of the housing 13.

In accordance with another feature of the present invention, and as best seen in FIG. 6, the housing 13 is provided with a plurality of detents 54, 56 and 58 that are interposed between reentrantly folded edges of the terminals 42, 44 and 46, respectively, to ensure that the grommert 22 is properly orientated in the recess 24 in the housing 13.

As best seen in FIG. 4, the grommet 22 is positively retained within the recess 24 in the housing 13 by a foldable latch 34 thereof that is permanently hinged to the housing 13 by a flexible membrane 60. The latch 34 has an end portion 62 with an angular surface 64 thereon complementary to the surface 32 on the grommet 22 so as to cam the grommet 22 into the recess 24 of the housing 13 upon closure of the latch 34.

As best seen in FIGS. 7 and 8 of the drawings, the latch 34 is maintained in the closed condition relative to the grommet 22 by a shoulder 66 on the latch 34 that locks behind a complementary detent 68 on the housing 13.

As best seen in FIGS. 9 and 10 of the drawings, a modified grommet 70 is operatively disposed in the grommet receptacle 24 of the housing 13. The grommet 70 is made from relatively rigid material, for example, hard plastic or hard rubber for the support of terminals 72, 74 and 76 similar to the terminals 42, 44 and 46. The grommet 70 is distinguished from the grommet 22 in that the grommet 70 is provided with a groove 78 for the acceptance of an O-ring 80. The O-ring 80 effects a seal with the wall of the grommet receptacle 24 in the housing 13 to preclude water or foreign materials from entering the housing 13.

In accordance with one feature of the grommet 70, a detent 82 thereon is accepted in a complementary recess 84 in the housing 13 to insure proper orientation of the grommet 70 therein.

It is to be noted that the grommet 70 is locked within the grommet receptacle 34 of the housing 13 in the same manner that the grommet 22 is locket therein, namely, by the interaction of a cam surface 86 on the grommet 70 with the complementary cam surface 64 on the latch 34 of the housing 13.

While the preferred embodiment of the invention has been disclosed, it should be appreciated that the invention is susceptible of modification without departing from the scope of the following claims.

I claim:

1. A socket for the reception of a bulb comprising:

a housing having a terminal strip internally thereof electrically engageable with said bulb, an elongated grommet receptacle in said housing, a grommet in said receptacle, an electrically conductive wire extending 6through said grommet in sealed relation thereto, a wire terminal on said wire releasably connectable to the terminal strip in said housing, a foldable latch on said housing engageable with said grommet to bias said grommet into the grommet receptacle in said housing and to maintain said grommet in the receptacle in said housing, and sealing means on the periphery of said grommet for sealing said grommet relative to the receptacle in said housing.

2. A socket in accordance with claim 1, wherein said grommet and the latch portion of said housing have complementary cam surfaces angularly related to the direction of movement of said grommet into said grommet receptacle and engageable to bias said grommet into said housing upon folding of said latch.

3. A socket in accordance with claim 1, wherein said housing has a detent thereon and the terminal on said wire terminal has a complementary recess therein for the acceptance of said detent whereby said grommet can be inserted into said grommet receptacle in only one orientation.

4. A socket in accordance with claim 1, wherein the sealing means on said grommet comprises a plurality of flexible ribs engageable with the grommet receptacle in said housing.

5. A socket in accordance with claim 1 wherein the sealing means on said grommet comprises an annular groove therein, and an O-ring in said groove engageable with the grommet receptacle in said housing.

* * * * *